United States Patent [19]

Heiskell

[11] Patent Number: 4,462,296

[45] Date of Patent: Jul. 31, 1984

[54] DRUMSTRICK FOR PLAYING PERCUSSION INSTRUMENTS

[76] Inventor: Ronald E. Heiskell, 2632 Mallard Ct., Union City, Calif. 94587

[21] Appl. No.: 460,672

[22] Filed: Jan. 24, 1983

[51] Int. Cl.[3] ..... G10D 13/02

[52] U.S. Cl. ..... 84/422 S; D17/22

[58] Field of Search ..... 84/422 S; D17/22

[56] References Cited

U.S. PATENT DOCUMENTS

| | | | |
|---|---|---|---|
| 1,484,777 | 2/1924 | Hassenpflug | 84/422 S |
| 3,175,450 | 3/1965 | Criscuolo | 84/422 S |
| 3,489,052 | 1/1970 | Colyer et al. | 84/422 S |
| 3,585,897 | 6/1971 | Stalcup | 84/422 S |
| 4,300,438 | 11/1981 | Handal | 84/422 S |

*Primary Examiner*—Lawrence R. Franklin

*Attorney, Agent, or Firm*—Keith T. Bleuer

[57] ABSTRACT

A drumstick having a handle portion that is sanded to produce circumferentially extending sanding scratches and ridges for rendering the handle portion relatively non-slippable in the hand of the musician. The tapered portion of the drumstick on which the striking bead is formed or mounted and also the butt end of the stick having a coating of polyurethane to render them capable of taking drum or cymbal striking contact without damage and to seal these parts against moisture. The handle portion after sanding to produce the sanding scratches and ridges has a relatively thin coating of water repellent on it that will allow the musician to feel the sanding ridges while also sealing the handle portion against moisture.

6 Claims, 6 Drawing Figures

DRUMSTRICK FOR PLAYING PERCUSSION INSTRUMENTS

Background of the Invention

The invention relates to percussion instruments and more particularly to drumsticks for playing such instruments.

Most of the prior drumsticks for playing percussion instruments, such as snare drums and cymbals, have been made of wood; although there are some that are made of plastic fabrics bonded together to form a single unit. Such drumsticks generally include a cylindrical handle portion, a striking bead at the forward end of the drumstick and a tapered portion between the handle portion and the bead. The handle portion is generally provided with a rounded butt end that is at times used in addition to the bead for striking a percussion instrument.

These sticks must be grasped lightly near the balance between the thumb and forefinger, or between the thumb, forefinger and middle finger so as to permit them to bound freely by somewhat pivotal movement, under the control of other fingers or other portions of the hand. This point of grasp cannot be much varied without destroying the control of the stick, and musicians often find difficulty in maintaining the proper hold on the stick due to perspiration in hot weather and that peculiar slippery condition produced by cold in winter.

Most of the commonly used drumsticks have been made of wood having a smooth, slick surface finish commonly produced by waxing or varnishing the wood surface, and these wood sticks in particular become slippery when moist or wet due to perspiration or rain. Some drummers have in the past sanded the cylindrical handle portions of the sticks in the longitudinal direction, parallel with the wood fibers and the grain of the wood, in order to increase the adhesion of the drumstick and fingers, but such sanding has been generally rather ineffective since the sanding striations, scratches, grooves and upstanding ridges produced by the sanding extend longitudinally of the stick along with the wood fibers, so that the stick can slip through the hand without very much restraint.

Summary of the Invention

It is an object of the invention to provide an improved hand gripping surface on such a wood drumstick so that the stick may be more easily held by the hand without slippage.

More particularly, it is an object of the invention to provide a roughened surface on the handle of the drumstick that has ridges at angles to the longitudinal dimension of the stick so that the stick is restrained from longitudinal movement through the drummer's hand as it is used.

In a preferred form, the drumstick of the invention is a wood stick and has a sanded handle surface with the sanding being carried out transversely to the longitudinal axis of the stick, so that the sanding striations, scratches, grooves and upstanding ridges extend transversely to the axis of the stick and to the wood fibers that extend longitudinally of the stick so that these sanding marks tend to grip the hand of the musician and prevent the stick from moving through the hand longitudinally of the stick. The tapered portion of the stick and also the butt end of the stick have a relatively thick, hard coating so as to withstand drumming impacts and prevent moisture from entering these parts, while the handle portion that is sanded is provided with a relatively thin moisture barrier coating so that moisture cannot be absorbed particularly from the perspiration of the musician with a possible resultant warpage of the stick.

Description of the Preferred Embodiment

Figure 1:
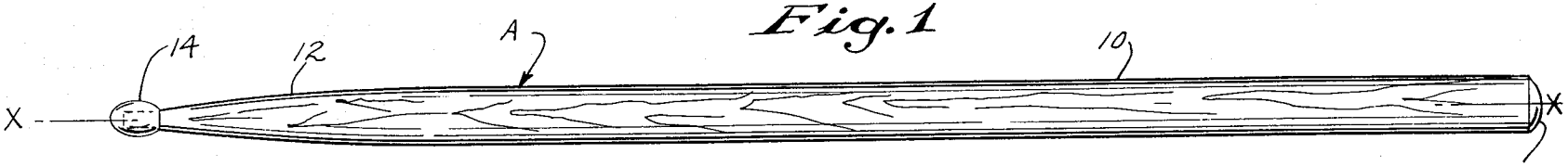
FIG. 1 is a side elevational view of a drumstick prior to a sanding operation on the handle portion of the drum stick according to the invention to produce sanding ridges and grooves for a relatively non-slip hand surface on the handle portion.
Figure 2:
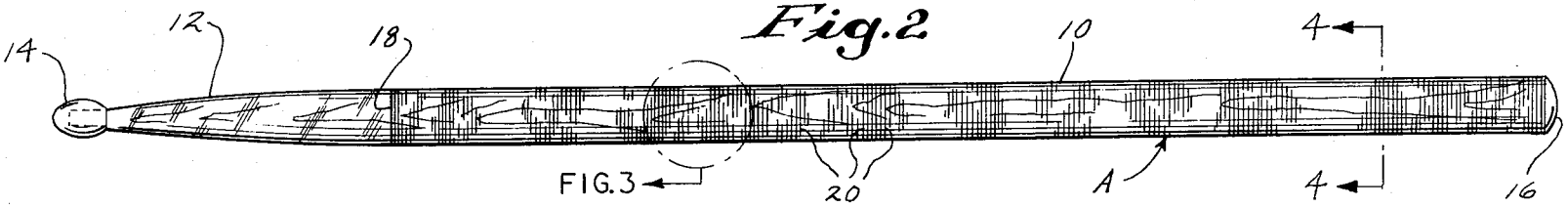
FIG. 2 is a side elevational view of the drumstick after the handle portion has been sanded to provide these ridges and grooves.

Referring to FIGS. 1–5 of the drawing, the drumstick A may be seen to comprise a cylindrical elongate handle portion 10, a tapered fore portion 12 connected to the handle portion 10 and shorter than the handle portion 10, a striking bead 14 on the end of the tapered portion 12 and on the forward end of the stick A, and a rounded butt end 16 on the rear end of the handle portion 10 and on the rear end of the stick A. All of the stick A, with the possible exception of the bead 14, is of wood, such as hickory; and the bead 14 may be of a plastic and fixed to the forward end of the tapered portion 12 as shown in the drawing. Alternately, the bead 14 may be integral with the rest of the stick A and of wood.

The tapered portion 12 is coated with polyurethane, and if the bead 14 is integral with the rest of the stick and is of wood, it is likewise coated with polyurethane. Likewise the butt end 16 is coated with polyurethane. The polyurethane coating in all of these instances, on the bead 14, the tapered portion 12 and the butt end 16 thus provides a hard surface on each of these parts so that they can stand impact from metal parts of a drum or cymbal, for example, without damage to these parts. Actually, a small part of the handle portion 10 may also have this polyurethane coating, to the dividing line 18 for example which is a little closer to the butt end 16 than the beginning of the tapered portion 12. The polyurethane coating on these parts also seals the wood so that moisture cannot enter it. The portion 12, since it is tapered, has the fiber endings of the wood exposed except for the polyurethane coating on the portion 12, and the same is true of the butt end 16. It is actually possible to blow air through the stick A from the butt end 16 to the tapered portion 12 assuming that the stick A is hickory and uncoated and it is thus clear that the tapered portion 12 as well as the butt end 16 should be coated and sealed; and the polyurethane coating on the portion 12 and end 16 accomplishes this required sealing.

The handle portion 10 is also sealed from moisture, and this is done by using a water repellent on the handle portion 10 which provides a coating which is relatively thin compared to the polyurethane coating on the portions 12 and 16. A particularly satisfactory water repellent is the commercial product "Woodyouth" ® manufactured by Roberts Consolidated Industries, City of Industry, CA 91749 and having the ingredients of 10.2% water repellent solids and 89.9% volatile hydrocarbons. This is a penetrating, paintable, non-swelling water repellent for wood and is a clear liquid before drying on the product. It guards against swelling, warping, shrinking and checking. The water repellent on the handle portion 10 and the polyurethane on the tapered portion 12 and on the butt end 16 effectively seal the stick from moisture so that the stick cannot warp due to moisture getting into the stick.

The handle portion 10, along the handle portion 10, is provided with a multitude of sanding scratches or minute channels 20 that extend in segments and in a series circumferentially about the handle portion 10. These scratches are exactly circumferential of the handle portion 10 and are on planes that are exactly normal or perpendicular to the longitudinal axis X—X of the stick A and thus to the grain and fibers of the wood of the stick A. The scratches or channels 20 are very shallow, and there may be an average depth of only 0.001 inch or 0.002 inch, for example, between the outer ridges **20*a* and the adjoining channel bottoms 20*b* of the channels 20 (see FIG. 5). The circumferential ridges 20*a* of the channels 20 provide in effect a non-slip grip outer surface on the handle portion 10, so that the musician's hand has little likelihood of slipping on the handle portion 10**, exactly contrary to the slipping that a hand may have along ridges that extend longitudinally of the stick as in the case of the prior art sticks that are sanded longitudinally of the stick.

Figure 6:
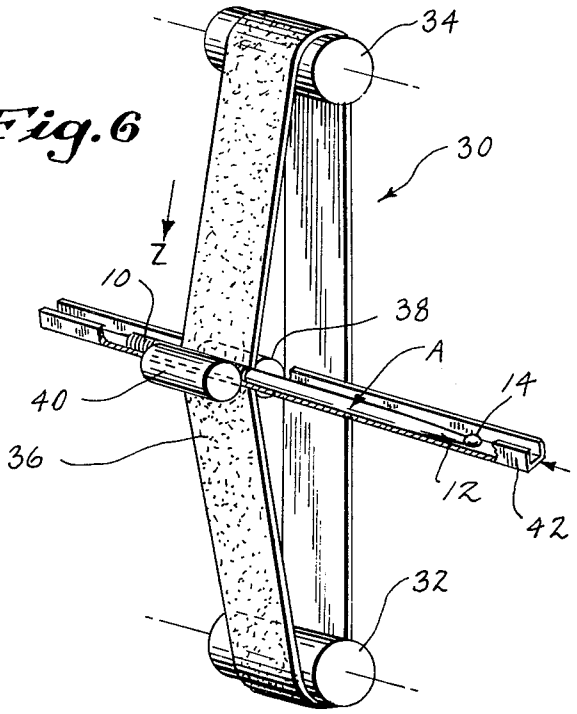
FIG. 6 is a perspective view of a sanding machine for sanding the drumstick to produce the sanding ridges and grooves in the stick.

In making the stick A, a sanding machine 30 as shown in FIG. 6 may be used. The sanding machine 30 includes a pair of opposite rolls 32 and 34 over which a sanding belt 36 passes. One of the rolls 32 or 34 is driven from a suitable motor, so that the belt travels at a fast speed in the direction Z. A backup roll 38 backs up the belt 36 so that a stick A may be pressed as by means of a pressure roll 40 against the front pass of the belt 36 to apply sanding pressure on the stick for effective sanding. A guide 42 is preferably provided for the stick A and holds the stick exactly perpendicular to the direction Z of travel of the belt so that the sanding belt provides the circumferential scratches or channels 20 about the stick A. The stick A is preferably rotated slowly as the stick is sanded by the belt 36. The belt 36 may typically have a #320 grit sanding surface on its effective face in order to provide the channels 20 that have been above described.

Figure 4:
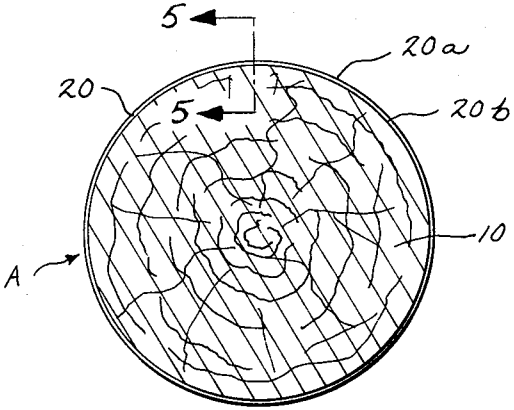
FIG. 4 is an end view of the drumstick also showing these ridges and grooves.
Figure 3:
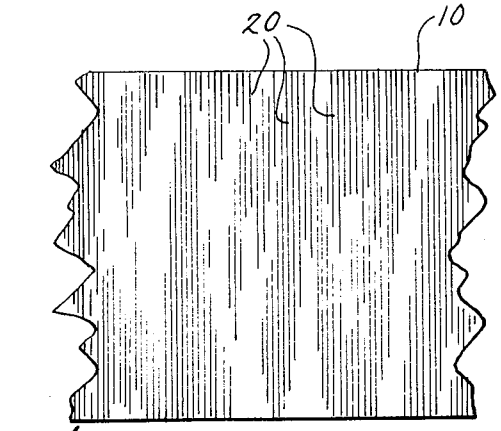
FIG. 3 is a fragmentary side elevational view on an enlarged scale of the drumstick showing more clearly these ridges and grooves.
Figure 5:
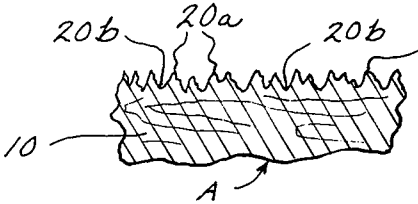
FIG. 5 is a sectional view of the drumstick on a still further enlarged scale and taken on line 5—5 of FIG. 4.

The order of manufacture of the stick A may be as follows: The stick A is initially shaped into the desired shape including the bead 14 if the bead 14 is to be of wood (see FIG. 1). If the bead 14 is to be a plastic bead, then the bead 14 may be attached to the stick A at this time. Preferably the stick A is made with the handle portion 10 larger than that ultimately desired, since the handle portion 10 will be sanded to reduce its diameter. The stick A may be initially formed using conventional equipment, such as lathes, etc. The stick A may then be submerged in liquid polyurethane and is then allowed to dry. This submerging may be for 11 minutes, for example, or for any time that is necessary for saturating the outer surface of the stick. The handle portion 10 is then sanded using the sanding machine 30 as above described so that the polyurethane coating on the handle portion 10 is removed and so that the channels 20 are formed on the surface of the handle portion 10 as are shown in FIGS. 3–5. This sanding is done on the handle portion 10 exclusive of the butt end 16 and exclusive of the tapered portion 12 and to the dividing line 18 (see FIG. 2) slightly farther from the forward end of the stick A than the end of the tapered portion 12. The stick A is then submerged in a water repellent such as the product "Woodyouth" ® above referred to. This may be for about 3 minutes so that the water repellent soaks in to the wood of the handle portion 10, and the stick A is then allowed to dry, such as for 24–48 hours. The stick A is then ready for use.

Another possible order of manufacture is as follows: The stick A is first formed using a lathe or similar machinery as above described. Then the stick is sanded using the machine 30 to reduce the diameter of the handle portion 10 and to provide the channels 20 in the handle portion 10. Then the stick is submerged and soaked in the water repellent, such as "Woodyouth" ®, as above described for about 3 minutes and is allowed to dry, such as for 24–48 hours. Then the butt end 16 and the tapered portion 12, only and exclusive of the handle portion 10, are submerged and soaked in liquid polyurethane, such as for 11 minutes, and these portions of the stick A are allowed to dry. The submerging of the butt end 16 and the tapered portion 12 are at separate times and are in tanks that have their levels of liquid polyurethane controlled so that the handle portion 10 that has been previously treated with water repellent does not have polyurethane applied to it.

Using either order of stick manufacture above described, the tapered portion 12 and the bead 14 (if the bead 14 is wood instead of plastic) are allowed to remain with the original polyurethane coating thereby strengthening the tapered portion 12 and the bead 14 against impact and wear from the metal parts of drums and cymbals and sealing these parts against the entrance of moisture into the stick A. In addition, the butt end 16 of the drumstick A is allowed to remain with the original polyurethane coating so that it is sealed against moisture and so as to provide a hard wear surface on the butt end 16 for drumming. These polyurethane coatings on the parts 12 and 16 are relatively thick and are thus very effective for their intended purposes, to take impact and to seal the fiber endings which in particular would tend to absorb moisture and cause stick warping. The coating on the handle portion 10 from the application of the water repellent "Woodyouth" ® or the like, on the other hand, is relatively thin thus allowing the drummer to feel the texture of the wood and the ridges **20*a* and making the surface of the handle portion 10 a relatively non-slip surface. This water repellent also seals the handle portion 10 from moisture, so that the stick A will not warp due to moisture entering it through the handle portion. There is also an added benefit from the water repellent, namely, making the surface of the handle portion 10 more non-slip under dry conditions. Incidentally, if the stick A is used in its original form as shown in FIG. 1**, but with polyurethane covering the stick, the stick would be sealed for its complete length against the entrance of moisture, but the stick would be very slippery when moist as from perspiration.

Although I have described my improved drumstick as being made from hickory wood, other woods such as maple or oak may be used instead. In fact, the sanded surface on the handle portion 10 would also be advantageous to reduce hand slip if the stick A were made from a plastic, such as a rolled-up fabric of constituent plastic fibers.

The number of channels 20 per unit length of the stick A may vary. The number of channels may, for example, be from 7 to 25 per millimeter (177–635 per inch).

I claim:

1. A drumstick comprising an elongate handle portion, a tapered fore portion shorter than said handle portion and integral with said handle portion, a striking head on the end of said tapered portion, and a series of minute circumferentially extending ridges and grooves from 177 to 635 per inch along said handle portion for providing a relatively even surfaced non-slip hand gripping surface on said handle portion.

2. A drumstick as set forth in claim 1, said drumstick constituting a stick of wood and said ridges and grooves being about 0.001 inch to 0.002 inch in depth and constituting sanding striations in the wood of the drumstick.

3. A drumstick comprising an elongate handle portion, a tapered fore portion shorter than said handle portion and integral with said handle portion, a striking head on the end of said tapered portion, a rounded butt end portion on the back end of the drumstick, a relatively thick coating of a moisture impervious plastic on said tapered fore portion and on said butt end portion, and a relatively thin coating of a waterproof substance on said handle portion for allowing a tactile effect of the surface roughness of the handle portion to be apparent to the user of the drumstick.

4. A drumstick as set forth in claim 3, said drumstick being of wood the fibers of which extend in the longitudinal direction of the drumstick so that the fiber endings are on said tapered portion and on said butt end portion and are sealed against the entrance of moisture between the fiber endings by said moisture impervious plastic on said fore portion and on said butt end portion.

5. A drumstick as set forth in claim 3, said handle portion having a series of minute circumferentially extending ridges and grooves on its surface and said thin coating of waterproof substance allowing said ridges and grooves to be apparent on said handle portion so that the ridges and grooves provide a relatively non-slip hand gripping surface on the handle portion.

6. A drumstick as set forth in claim 5, said drumstick being of wood the fibers of which extend in the longitudinal direction of the drumstick so that the fiber endings are on said tapered portion and on said butt end portion and are sealed against the entrance of moisture between the fiber endings by said moisture impervious plastic on said fore portion and on said butt end portion.

* * * * *